United States Patent [19]

Nagata et al.

[11] 4,421,790

[45] Dec. 20, 1983

[54] METHOD FOR COATING THE INNER SURFACE OF LONG TUBES OF SMALL DIAMETER

[75] Inventors: Koji Nagata; Mamoru Nishikawa; Shiro Sato, all of Nagoya, Japan

[73] Assignee: Sumitomo Light Metal Industries, Ltd., Tokyo, Japan

[21] Appl. No.: 421,343

[22] Filed: Sep. 22, 1982

Related U.S. Application Data

[62] Division of Ser. No. 228,682, Jan. 26, 1981, Pat. No. 4,370,944.

[30] Foreign Application Priority Data

May 14, 1980 [JP] Japan ..... 55-63681

[51] Int. Cl.[3] ..... B05D 7/22; B05D 1/02

[52] U.S. Cl. ..... 427/236; 427/422

[58] Field of Search ..... 427/236, 422

[56] References Cited

U.S. PATENT DOCUMENTS 2,520,397 8/1950 Green ..... 427/236 X

FOREIGN PATENT DOCUMENTS 970737 9/1964 United Kingdom ..... 427/236

*Primary Examiner*—James R. Hoffman

*Attorney, Agent, or Firm*—Browdy and Neimark

[57] ABSTRACT

A coating method for coating the inner surface of a long tube of small diameter, specifically tubes for a condenser. The coating is a type of spray coating wherein a long flexible supply hose, longer than the long tube to be coated, is reciprocated in the long tube with a spray nozzle attached to the tip thereof for spraying the paint by the action of compressed air, from one end of the long tube to the other end thereof while spraying the paint in atomization. The long flexible supply hose of double structure or sometimes of triple structure is composed of a short heating pipe portion adjacent to the spray nozzle and a long flexible hose portion. The paint and compressed air supplied through separate passages in the supply hose are heated to a predetermined temperature by heating means, for example, a sheathed electrical heater wound about an inside pipe of the heating pipe portion upstream of where the paint is sprayed.

3 Claims, 8 Drawing Figures

METHOD FOR COATING THE INNER SURFACE OF LONG TUBES OF SMALL DIAMETER

REFERENCE TO RELATED APPLICATION

This is a division of parent application Ser. No. 228,682, filed Jan. 26, 1981, and now issued as U.S. Pat. No. 4,370,944.

FIELD OF THE INVENTION

This invention relates to a method and apparatus for coating the inner surface of long tubes of small diameter, and more particularly to a method applicable to protective coating of a heat exchanger tube or condenser tube employed in a condenser of a steam turbine, used for a power plant, being especially effective in performing the coating where the tube is in an installed condition in the plant, and an apparatus therefor.

BACKGROUND OF THE INVENTION

In thermal power plants condensers have been traditionally used for cooling the exhaust gas (steam) of a steam-turbine to condense it and recycle the condensed water. In a condenser of such use thousands of or sometimes tens of thousands of long tubes of copper alloy, for example 5–40 m in length, having a small inner diameter on the order of 10–40 mm are incorporated as condenser tubes. Those tubes, which pass the cooling water such as sea water therethrough, are adapted to cool the exhaust steam passing thereoutside.

Those condenser tubes, which constantly pass the cooling liquid such as sea water containing many corrosive substances at a fairly high flow speed, for example 1–2.5 m/sec., are susceptible to various types of corrosion or erosion. It is therefore necessary to cover or coat the whole inner (internal) surface of those tubes with a protective synthetic resin coating or paint for the purpose of corrosion-and-rust resistance. The coating must avoid degradation of the heat transfer qualities, which is of course the essential function of the condenser tubes. Thus, a thin on the order of 10–30$\mu$ and uniform filmy coating which will not deteriorate the heat transferring or exchanging capability is needed for the protective coating of a heat conducting tube such as a heat exchanger tube in a heat changer like a condenser.

Such tubes having a thin filmy coating in the interior thereof is sometimes necessitated to repaint or recoat, before the life of the whole plant for example 20 or 30 years comes to an end, because the thin coated film (a) may be worn away after the tubes being installed in the plant to expose the ground metal by a mere aging, (b) may be eroded by shells or sand grains contained in the sea water, or (c) may be worn pre-maturely by the so-called sponge ball cleaning method used to remove foreign matters stuck to the tube such as seaweeds. The interior coating of resin paint film of the tubes are sometimes shorter in life than the plant itself, and it must be periodically or occasionally repainted (recoated) particularly in an installed state in the plant.

Conventionally practiced methods, mostly used for painting the interior of relatively short tubes ranging the whole length thereof, that is, flow coating method of flowing paint through a tube or brush coating method of brushing paint directly on the inner surface of the tube, have been defective for being applied to long tubes of small diameter in being difficult in getting a uniform-thick coated film. Particularly the former method is not good when it is applied to a tube already installed in a condenser, because the tube can not be inclined for flowing out the superfluous paint. Both are as a matter of fact hardly recognized of their practicality at the present stage.

As another method of relatively high practicality a spray coating method, wherein nebulized or atomized paint by a spray gun is coated on the inner surface of a tube, can be named. Sometimes a long necked spray gun with a length of 500 mm or so is inserted in the tube, but it is not free from a problem that the length of the tube to be effectively coatable by this spray gun is naturally restricted to some extent. Still another method, as a variation of the above, for avoiding the problem, is relatively widely practiced, wherein a moving nozzle which is shiftable from one end of a tube to the other end while spraying the paint is employed. In any way problems are still left unsolved as to what length of the tube interior can be well coated by the spray coating method. Even the latter, when it is applied to coating of the interior of a condenser tube of small diameter and large length, particularly in a heat exchanger tube of a condenser, leaves something to be desired. For example, as the coated film is apt to be largely influenced by temperature, humidity and other environmental conditions, it is very difficult to keep the film thickness at a desired uniform value in coating an already installed long tubes of small diameter where the necessary environmental conditions are almost out of control; uneven thickness or defective coating of the film may as a result take place there. When the tube to be coated is a long heat exchanger tube, varying the thickness of the coated film is likely to cause variation of the heat conducting or transferring capability. Thus, strict control of the environmental conditions for keeping the coating thickness even is of great importance.

Generally the thickness (t) of a coated film is regulated by an undermentioned formula, $$t = \frac{q \times \alpha}{\pi \times Di \times v \times \rho}$$

wherein, q: discharge amount of the paint $\alpha$: solid ratio of the paint

Di: inner diameter of the tube to be coated v: shifting rate of the spray nozzle $\rho$: density of the coated film.

That is to say, the thickness (t) of the film is given as a function of the discharge amount (q) of the paint, solid ratio ($\alpha$), i.e. of the solidified portion (component to be remained), of the paint, and the shifting rate (v) of the spray nozzle. Out of those (q) and (v) can be easily made constant independently of the environmental conditions of coating, but ($\alpha$), the ratio of the solidified portion of the paint, is determined by the mixing ratio of the synthetic resin, pigment, and solvent. Coating is however practiced generally, irrespective of the environmental temperature, at a most suitable paint viscosity for spraying. The viscosity of a film forming substance such as synthetic resin depends, on the other hand, upon the temperature, so it is necessary to vary the mixing ratio of the solvent in the paint according to the environmental temperature under which the coating is carried out so as to keep a constant viscosity of the paint to be coated. In other words, the value $\alpha$ in the general formula mentioned above is varied to consequently change the thickness (t) of the film.

Observing this problem from the view point of defects of the coated film, operations at the plants in cold districts or in a winter season draw particular attention. The solvent ratio must inevitably be raised in such cases because of the remarkable low level of the ambient temperature for getting the predetermined viscosity of the paint. This consequently results in dripping or gathering of the paint toward the lower side of the tube due to elongation of the film forming time duration, remelting of the once solidified film in response to increasing of the solvent evaporating amount, and undesirable environmental pollution due to the evaporation of the solvent in large quantity.

Hot spray coating was proposed, on the other hand, to eliminate those disadvantages. Traditional technology of heating the paint or the air employed at the source thereof, be it by the paint heating method or the hot air spray method, is very impracticable from the view point of applying the same to the inner surface of long tubes of small diameter. Because, in the condenser tubes of large length already installed in a condenser or the like the distance from the paint reservoir to the end of the spray nozzle is not less than 20 m at the least, and consequently maintaining the temperature of the paint at a predetermined level is difficult. In case of the hot air spraying method supply of the required hot air of large quantity, such as 200–500 l/min., passing such a long distance needs a huge equipment for elevating and maintaining the temperature to and at a necessary level. This is the Achilles heel of the hot spray coating method in the practical application thereof.

An ideal method for coating a thin film of uniform thickness to the inner surface of a long tube of small diameter has not been established. Particularly in case of an already installed condenser tube in the condenser protective coating is confronted at the present stage with many technical difficulties. Actually the tubes which have been worn away of the coating due to the causes mentioned above in the running condition, have to be replaced by new ones completely coated, which causes a huge amount of working and material cost, bringing about a great loss.

SUMMARY OF THE INVENTION

The present invention was made from such a background. It is therefore a primary object of this invention to provide an effective and practical method of coating the inner or internal surface of a long tube of small diameter and an apparatus therefor.

It is another object of this invention to provide an effective and practical method of protective coating to the inner surface of a long condenser tube of small diameter chiefly utilized in a condenser or the like in a power plant, particularly in an installed state in place, for giving a great financial benefit, and an apparatus therefor.

It is still another object of this invention to provide a method and apparatus for forming a protective coating with uniform film thickness of paint in the range 10–30$\mu$, applicable on the inner surface of condenser tubes used in a surface condenser without affecting the heat transfer performance thereof.

Other objects of this invention will become apparent to those skilled in the art from the following detailed description of the preferred embodiments when read in connection with the accompanying drawings.

The present invention has developed a supplying hose, utilized in a type of spray coating for coating a long tube of small diameter, wherein a paint atomizing nozzle is moved from one end of the tube to the other end thereof, which supplying hose is longer than the tube to be coated for being inserted through the long tube when the coating is carried out, and the paint and the compressed air are respectively heated in the supplying hose to a predetermined temperature so that the heated paint is sprayed in an atomized stage by the similarly heated compressed air through the nozzle. This invention has thus enabled the formation of a thin and uniform thickness film on the inner surface of a long tube of small diameter, without producing any unevenness and other defects in the coated film.

According to this invention a supplying hose having a spray nozzle disposed on the tip thereof and passages for the paint and the compressed air is inserted into the long tube to be coated from one opening end thereof. When the nozzle has reached the other opening end of the long tube, the supplying hose is drawn back at a predetermined speed or rate toward the firstly inserted opening end, while performing the paint spraying from the nozzle. The paint and the air are respectively delivered from a paint reservoir and a compressed air tank of air-transformer type located outside the long tube through the supplying hose longer than the long tube to be coated; and the paint and the air are respectively heated to a predetermined temperature in the course of being delivered to the nozzle for being sprayed therefrom. It enables the paint to be sprayed under the predetermined atomization conditions constantly, eliminating the necessity of varying the solvent ratio for adjusting the viscosity of the paint. Inevitable varying of the film thickness, gathering of the paint to a lower place, insufficient curing of the paint, defects of coated film owing to the remelting of the paint, and the environmental pollution due to the variation of solvent ratio in the midway of a coating process have been effectively eliminated. A practical coating method has thus been established which is completely free from the changeable ambient conditions which affect the coating outcome. The invention can be applied, therefore, to a protective or anti-corrosion coating of the already installed condenser tubes in a running plant under different conditions, which has solved the problems traditionally hampered the coating of the tubes under operation with a uniform thickness film.

DETAILED DESCRIPTION OF THE PREFERRED EMBODIMENTS

With reference to the appended drawings a detailed description of the preferred embodiments will now be made.

Figure 1:
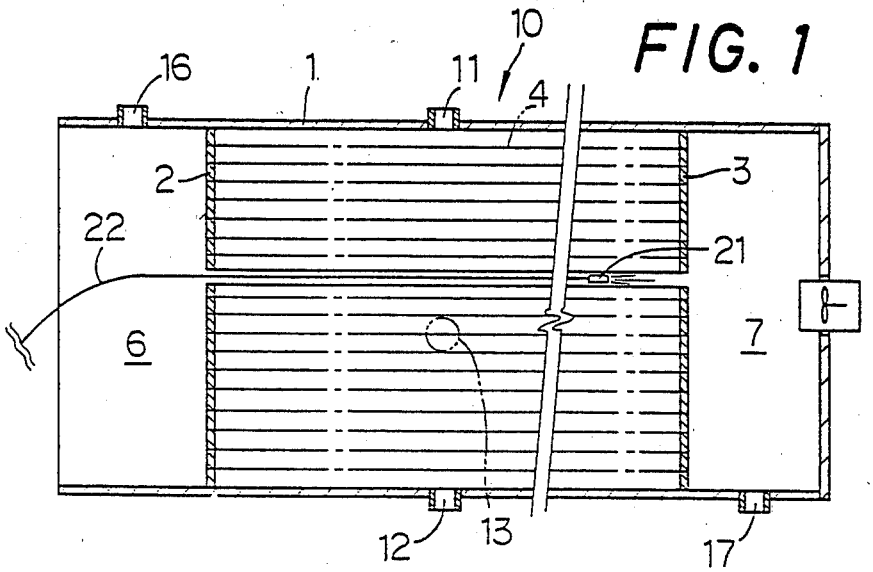
FIG. 1 is an explanatory sectional view of a condenser in which this invention is preferably applied.

A surface condenser 10 employed in a thermal power plant (station), being connected with a steam-turbine, is shown in FIG. 1, wherein a large cylindrical fluid-tight sealable condenser shell 1 is divided into three chambers (condenser water boxes) with a pair of condenser tube plates 2 and 3 disposed one at either end. In the central portion sandwiched by the pair of plates 2, 3 thousands of or tends of thousands of condenser tubes 4 of copper alloy with the diameter of 10–40 mmϕ are parallelly disposed extending along the length of 5–40 m. On either end portion of the condenser shell 1 outside the tube plates 2, 3 condenser water boxes 6 and 7 are respectively formed.

On top of the condenser shell 1 (hereinafter simply called shell) a steam inlet 11 is disposed centrally located for receiving the exhaust steam from the steam turbine; on the lower side of the shell 1 a condensed water recovering (receiving) inlet 12 is made, similarly centrally located in the lateral direction, as can be seen in FIG. 1. In the condenser water box 6 on the left side of FIG. 1 a cooling water outlet 16 is provided on top of the shell 1; in the right side of the water box 7 a cooling water inlet 17 is provided on the lower side of the shell 1. A vent 13 is formed on one flank of the shell 1. The cooling water inlet 17 and the cooling water outlet 16 are respectively connected to a circulating water pump; the condensed water receiving inlet 12 is connected to a condensate pump; and the vent 13 is connected to a vacuum pump. These pumps are however not shown in the drawings. In short, the cooling water in a condenser 10 of this type is flowed through the condenser tubes 4 from right to left in FIG. 1, while the exhaust steam from the steam turbine is passed through the gap left among the condenser tubes 4 almost downwardly on the other hand, so as to perform a heat transference between the cooling water and the exhaust steam through the contact of both at the wall of the condenser tubes with a result of condensing the exhaust steam into water.

In making anti-corrosion coating of the whole length of the interior of such condenser tubes 4 in the condenser 10, a coating operator enters into one, or both when it is necessary, of the condenser water boxes 6, 7 on the end portion of the condenser 10 for operating the spray nozzle there. Assuming a concrete example where the operator works in the water box 6, he inserts a supplying hose 22 having a spray nozzle 21 on the tip thereof and respective passages for paint and compressed air into one side opening of a condenser tube 4 and continues to push it deeper therein until the spray nozzle 21 reaches, passing through the whole length (5–40 m) of it, the other end opening of the condenser tube 4 on the side of the water box 7. When the spray nozzle 21 has reached the destination, the supplying hose 22 begins to be drawn back with a mechanical means at a predetermined speed, upon starting the spraying of the paint. The paint sprayed is supplied from a paint reservoir (not shown) situated in the water box 6 or outside the condenser 10, with the aid of the compressed air coming from a similarly situated air transformer (not shown) through the separate passage. The paint is atomized for being sprayed at the nozzle 21 with the aid of the compressed air in a well known way. With the starting of spraying paint the nozzle 21 is pulled back by the earlier stated mechanical means steadily from the water box 7 toward the water box 6 while continuing the coating operation regularly throughout the whole length of the condenser tube 4. Upon completely pulling back the supplying hose 22 to the starting place spraying of the paint is ceased by the stoppage of supplying the compressed air. At the finish of painting of a first condenser tube 4 similar operation begins with a second condenser tube 4, and then with a third. The protective coating of the many condenser tubes 4 is continued in the same method until all of them in the condenser 10 are re-coated.

Such a coating process which is susceptible to various environmental conditions, such as temperature, humidity, etc., requires to be maintained at an optimum situation for forming a non-defective and uniform thickness film. The present invention is aimed at obtaining an optimum spraying condition of the paint through nebulization or atomization of the paint at the spray nozzle 21 by means of supplying the paint and the compressed air, through the respective passage in the supplying hose 22, heated at a most preferable temperature for coating such as 15°–35° C.

As a method for heating the paint or the compressed air in the supplying hose 22 according to this invention, there are variety of effective ones available such as directly heating them by an electric heating means, for example, an electrical heating wire; cycling a heating medium in the supplying hose 22, or combination of those means, etc.

Figure 2:
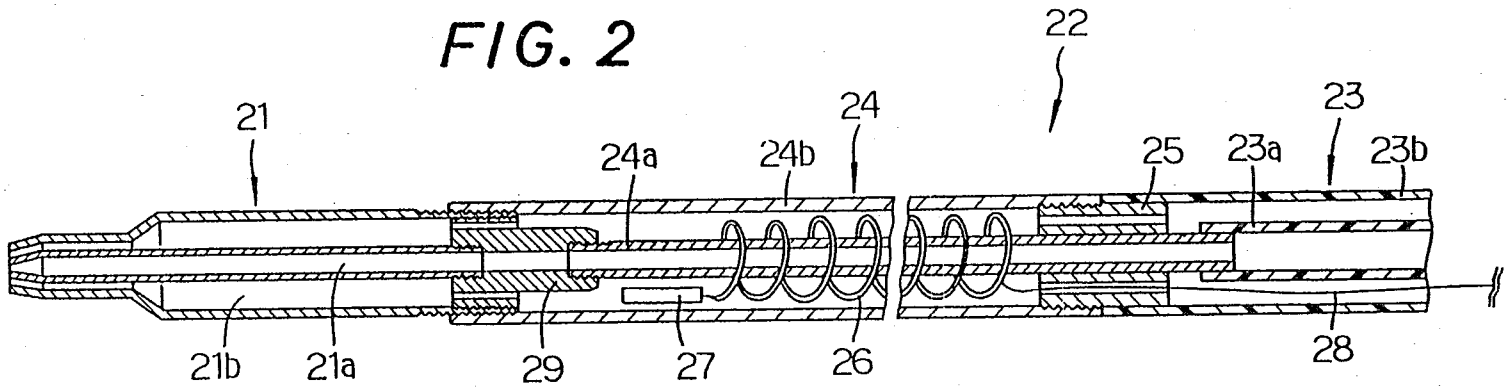
FIG. 2 is an axial sectional view of an apparatus in accordance with this invention.

What is illustrated in FIG. 2 is an example of electrical heating means, being effective in realizing this invention and extremely simple in structure, wherein a front end portion of a nozzle is shown as an axial sectional view. The paint and the compressed air delivered thereto heated there up to a predetermined temperature in a very short time.

According to FIG. 2, the spray nozzle 21 of ordinary structure is provided with a paint passage **21*a* in the central part and an air passage 21*b* embracing the former completely in it for spraying the paint by the action of the compressed air in atomization state. The supplying hose 22 to which the nozzle 21 is attached is composed of a flexible hose 23 of double-structure leading the paint and the compressed air from outside the condenser tube 4 and a metallic heating pipe 24 of a predetermined length for heating the paint and the compressed air delivered thereto by the flexible hose 23**.

The flexible hose 23 is constituted of an inside tube **23*a* made of polyvinyl chloride or the like for forming a paint route or passage and a flexible outside tube 23*b* made of hard plastic for example hard nylon or metallic flexible tube being concentric with the inside tube 23*a* to form an air route or passage therebetween. The heating pipe 24 which is attached with a joint 25 to the tip of the flexible hose 23, just like the latter, of double structure consisting of an inside pipe 24*a* and an outside pipe 24*b*. The inside pipe 24*a* is communicated with the inside tube 23*a* for forming a paint passage and the outside pipe 24*b* is communicated with the outside tube 23*b* for forming an air passage. Around the external surface of the inside pipe 24*a* a sheathed heater 26, for example sheath element 0.2–1 mmϕ and external diameter of the sheath 1.6–4.8 mmϕ, as an electric heating means is wound like a coil for heating directly the compressed air and indirectly, via a pipe wall of the inside pipe 24***a*, the paint under the control of a thermostat 27 attached to the tip of the sheathed heater 26. Power supply to the sheathed heater 26 is executed by a lead wire 28 extending through the outside tube 23*b* so far as to get out of the condenser tube 4; and the sheathed heater 26 is covered by a stainless-steel-made tube for being completely separated from the inside pipe 24*a* for feeding the paint, so there is no likelihood and no danger of a fire or an explosion. The above-mentioned heating pipe 24 is, at the tip thereof, connected to the nozzle 21 by way of a joint 29; the inside pipe 24*a* is connected to a paint passage 21*a* of the nozzle 21 and the outside pipe 24*b* is connected to an air passage 21*b* of the nozzle 21.

With such a structure, the paint and the compressed air delivered from outside the condenser tube 4 through the flexible hose 23 are respectively heated to a predetermined temperature by the sheathed heater 26 at the heating pipe 24 for being immediately led to the nozzle 21, where the heated paint is sprayed in atomization by the action of the similarly heated compressed air. Incidentally, for heating the paint and the compressed air from 5° C. to 30° C. respectively, under the condition that the compressed air gushing (blowing) amount is 300 l/min. and the paint discharging amount is 100 ml/min., the sheathed heater 26 has only to be maintained at 150° C. provided that it has the length of 360 mm under the control of the thermostat 27. The length of the heating portion with the sheathed heater 26, i.e., the length of the heating pipe 24 may be suitably determined depending upon the compressed air amount, the paint discharge amount, the material quality of the heater's inserting portion, the heating condition, etc., with a variety of choice, for example, from ordinary length of approx. 300 mm to an extremely long case of covering the whole length of the supplying hose 22. In a case wherein the paint and the compressed air are heated ranging the whole length of the supplying hose 22, the same pipe is preferable to be flexible over the whole length from the view point of easiness of its handling, and required to be made of a material sufficiently resistive to a temperature of 40°–60° C. It is effective to employ a heat-resistant plastic for both the inside tube and the outside tube of the supplying hose 22 or employ a metallic flexible tube for the outside tube.

Figure 3:
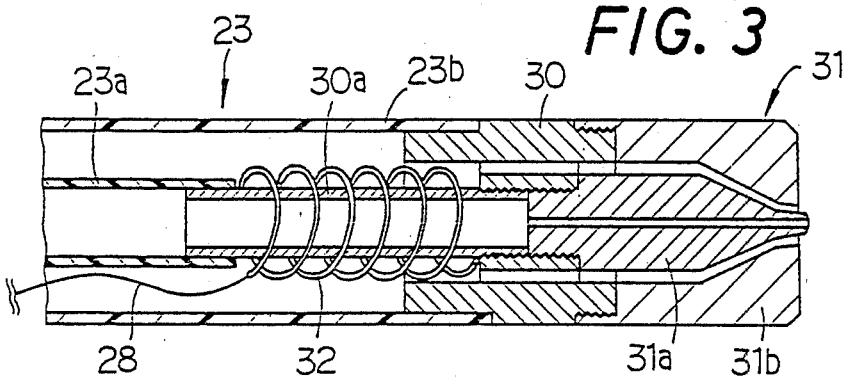
FIG. 3 is a sectional view, in an axial direction, of another apparatus in accordance with this invention.

In FIG. 3 another embodiment of this invention, wherein a different sheathed heater from that in FIG. 2 is employed, is shown. A spray nozzle 31 is connected therein by way of a joint 30 to a flexible hose 23 as the supplying hose 22. On one end of the joint 30 a nozzle insert 31*a* is coaxially threaded, which is in turn threaded on its external side by a nozzle cap 31*b*. A gap formed between the nozzle insert 31*a* and the nozzle cap 31*b* constitutes a passage for the compressed air. On the other end of the joint 30 the outside tube 23*b*, which delivers the compressed air in the flexible hose 23 of double structure, is firmly fitted; and at the same time on a metallic inner tube 30*a*, which is fitted into a central through-bore of the joint 30, the inside tube 23*a* for feeding the paint is firmly fitted. On the external surface of the metallic inner tube 30*a* fitted into the joint 30 a sheathed heater 32 is wound about for heating the paint and the compressed air by being supplied with power through a lead wire 28 running along the outside tube 23*b*, just like in the previous embodiment. As the length of the heating portion in the structure of this embodiment coincides with that of the inner tube 30*a* wound by the sheathed heater 32, which facilitates the adjustment of the length thereof relatively easily. The outside tube 23*b* of the flexible hose 23 can be utilized, as it is, as an outside tube to the inner tube 30*a*, advantageously eliminating the putting of a separate metallic pipe as in FIG. 2.

Figure 4:
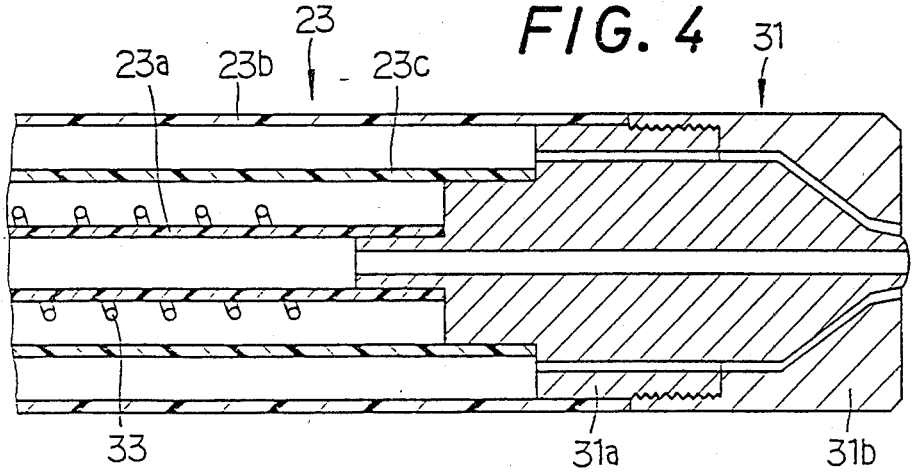
FIG. 4 is an axial sectional view of still another apparatus in accordance with this invention.

Still another embodiment with an electrical heating means such as a sheathed heater is shown in FIG. 4, wherein a flexible hose 23 as the supplying hose 22 is, unlike the previous ones, of triple structure. Between an inside tube 23*a* and an outside tube 23*b* a median tube 23*c* is coaxially disposed. On the external surface of the inside tube 23*a* a sheathed heater 33 is wound about, while a gap formed between the inside tube 23*a* and the median tube 23*c* is filled with a suitable heat conducting medium such as air, water, etc., which functions along with a sheathed heater 33 to heat the paint fed through the inside tube 23*a* and the compressed air fed through the outside tube 23*b* respectively to a predetermined temperature.

In such a structure, the paint and the compressed air in the flexible tube 23 are maintained at a suitable temperature, even when the coating operation is temporarily suspended by a stoppage of heating with the sheathed heater 33 by any chance, by the heat kept in the heat conducting medium. The paint and the compressed air are advantageously protected from being affected by the ambient conditions immediately. This structure is particularly useful in a system wherein the heating means is disposed ranging the whole length of the supplying hose 22.

Several embodiments described above are all concerned to systems in which an electrical heating means is adopted; this invention is however applicable to another type of apparatus wherein heated fluid is circulated in the supplying hose.

Figure 5:
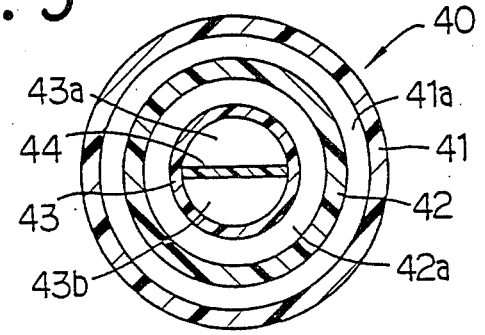
FIGS. 5 and 6 are respectively a cross sectional view of a supplying hose employed in further apparatus in accordance with this invention and an exploded axial sectional view of the apparatus.
Figure 6:
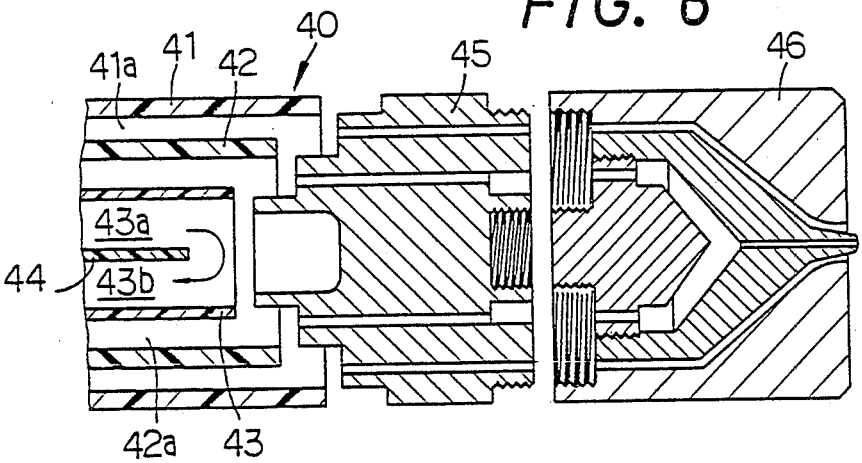

In an embodiment shown in FIGS. 5 and 6 a flexible hose 40, which extends from outside of the condenser tube 4 to a predetermined position in the condenser tube 4, is constituted of an outside tube 41 of hard plastic for forming a compressed air passage 41*a*, a median tube 42 for forming a paint passage 42*a*, and an inside tube 43 of heat resistant plastic for forming a passage (forward and backward) of the heated fluid. Three of those are all coaxially arranged to make a triple structure. And in the inside tube 43 a long partition is disposed in a diametric direction ranging the whole length of the tube to divide the inside into two parts, i.e., forward flowing passage 43*a* and a backward flowing passage 43*b*. To the end portion of the flexible hose 40 a spray nozzle 46 is attached by way of a suitable joint 45. The inside tube 43 is not blocked by the joint 45, but the forward flowing passage 43*a* and the backward flowing passage 43*b* thereof are communicated to each other only in the end portion, that is, in the attaching portion of the spray nozzle 46. Accordingly, warm and heated water from a water supplying tank similarly disposed as the paint reservoir outside the condenser tube, or heated air (or other heated fluid) from a suitable heating means comes through the inside tube 43, specifically through the forward flowing passage 43*a*, to the vicinity of the attaching portion of the spray nozzle 46, where it is flowed back through the backward flowing passage 43*b* to outside of the condenser tube 4. In the circulating course of such a flowing forward and backward of the heating medium through the forward flowing passage 43*a* and the backward flowing passage 43*b*, the paint and the compressed air flowed through the respective passage (41*a*, 42*a*) are heated by the heating medium up to a predetermined temperature.

When such a circulated system of a heating medium is adopted, the amount of the medium used is, in contrast to the amount of the medium in a direct heating type of hot air system, small and economical because of a possible small size of the heater capacity, outside the condenser tube 4.

If a metallic heating tube of small length, like one in FIG. 2 designated with 24, is attached in the above embodiment to a portion adjacent to the nozzle 46, the paint and the compressed air will be further stabilized in their required temperature.

The same object can be attained by incorporating a sheath heater in the inside tube 43 and by cycling only the air therethrough.

Figure 7:
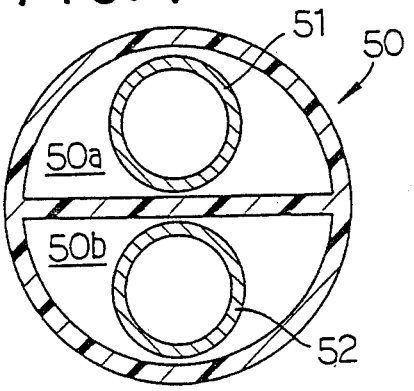
FIGS. 7 and 8 are respectively a cross sectional view of a supplying hose employed in still further apparatus in accordance with this invention.
Figure 8:
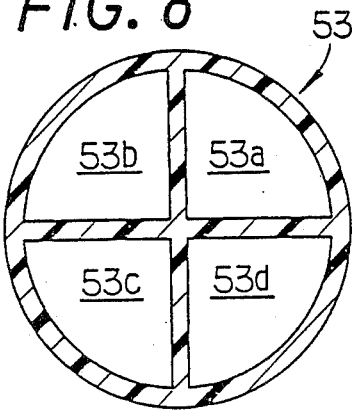

Other examples of heating by means of heated fluid can be seen in FIG. 7 and FIG. 8, both being effective.

In a half-splittable type flexible hose 50 of hard plastic, shown in FIG. 7, a pair of small diametered tubes 51, 52 of heat resistant vinyl resin are respectively inserted into a pair of sections 50*a*, 50*b* formed in the flexible hose 50. Either one, for example, 51 is adapted to pass the paint and the other may be adapted for passing the compressed air; and one section 50*a* is used as a forward flowing passage for the heating medium and the other section 50*b* as a backward fluid passage of the same. In this embodiment sheathed heaters may be wound about each of the small diametered tubes 51, 52 in a coil style ranging the whole length of the tube for heating the paint and the compressed air. In an embodiment shown in FIG. 8, a supplying hose 53 is divided into four sections, one pair of diagonally positioned sections 53*a*, 53*c* are used for the paint and the compressed air feeding, and the other diagonally positioned sections 53*b*, 53*d* are used for the forward flowing passage and the backward flowing passage of the heating medium.

Those supplying hoses 50, 53 are all connected via a suitable joint to a spray nozzle, and the heating medium is flowed through a forward flowing passage (50*a*, 53*b*), which is respectively one of the passages in the supplying hose, up to the vicinity of the connecting portion of the spray nozzle, where it is flowed back through respective backward flowing passage (50*b*, 53*d*) outside the system, while the heating medium is thus circulated from the forward flowing passage to the backward flowing passage, the paint and the compressed air are respectively heated, by way of the tube or hose wall, up to a predetermined temperature, so that the paint may be sprayed by the compressed air at atomization state.

This invention is by no means limited to the above-mentioned methods and apparatuses, but it can be varied and modified in many ways within the spirit of this invention by those skilled in the art. As to the paint to be used in this invention, variety of ones suitable to the coating of long tubes of small diameter can be enumerated; among those some organic synthetic resin coatings or paints, which may be cured at room temperature or its neighborhood, are preferable for the purpose of anti-corrosion coating. As their base or vehicle alkyd resin, vinyl chloride resin, polyurethane resin, epoxy resin, silicone resin, acrylic resin, etc., are exemplified.

Before concluding the description an experiment for clarifying the effect of this invention will be disclosed hereunder.

In a condenser provided with 6200 condenser tubes of copper alloy (JIS H 3300), whose dimension was 25.4 mm in the external diameter, 22.9 mm in the internal diameter, and 15330 mm in the length, the protective coating method was applied to 1500 condenser tubes out of all.

First of all the condenser tubes to be coated were repeatedly cleansed fifty times by sponge balls with silicon carbide grains stuck thereon, followed by water cleansing, draining and drying.

After the above-mentioned cleansing the tubes were coated by the apparatus shown in FIG. 2 for protecting from corrosion. It was carried out under rather severe condition to the eyes of those skilled in the art such as:

| | |
|---|---|
| ambient temperature | 5–10° C. |
| humidity | 60% |
| The paint used was: | |
| kind | zinc chromate primer |
| viscosity | 20 sec. by No. 4 Ford viscosity cup (15° C.) |
| The coating conditions were: | |
| amount of the paint discharged | 60 ml/min. |
| amount of the air supplied | 300 l/min. |
| shifting velocity of the nozzle | 500 mm/sec. |
| The drying condition: | |
| the wind velocity | 2.5 m/sec., 24 hours |

After the anti-corrosion coating, the result was examined in all of the 1500 condenser tubes. A part of the tube end 1.5 m from the end opening was visually examined with a tube examining scope. On the side from where the wind gets out, some flowing downward or gathering of the paint was found within 1 meter range from the end opening in only ten tubes out of the 1500 tubes.

The result may be said surprisingly excellent considering the severe conditions under which the coating was carried out.

In a measuring test of the thickness of the coated film on the lower side of the tube at a position 500 mm from the end opening executed with a vortexical film-thickness meter to find an average thickness of 18.5$\mu$. And the standard deflection (declination) was so good as 2.5$\mu$.

What is claimed is:

1. A method for coating the inner surface of a long tube of small diameter by a spray coating, wherein a spray nozzle for spraying a paint is shifted from one end opening of the long tube to the other end opening thereof comprising:

inserting a supplying hose, longer than said long tube, provided with said spray nozzle attached to the tip of said supplying hose and respective passages for flowing the paint and flowing compressed air to said nozzle, into said long tube; and heating said paint and said compressed air up to a predetermined temperature within said respective passage for spraying the heated paint from said nozzle by the action of the similarly heated compressed air.

2. A method claimed in claim 1, wherein the long tube to be coated is a condenser tube in a surface condenser, and said condenser tube having the inner diameter in the range of 10–40 millimeters and the length in the range of 5–40 meters is coated on the inner surface thereof with a coating film of 10–30$\mu$ thickness.

3. A method claimed in claim 1, wherein the paint and the compressed air to be supplied to said nozzle are heated to a temperature of 15° C. to 35° C. within the respective passage of the supplying hose.

* * * * *